United States Patent [19]

Bussan et al.

[11] Patent Number: 4,934,541

[45] Date of Patent: Jun. 19, 1990

[54] REFRIGERATOR SHELF AND METHOD OF MANUFACTURING

[75] Inventors: Marc R. Bussan, Evansville; Charles G. Fellwock, Scott Township, Vanderburgh County, both of Ind.

[73] Assignee: Whirlpool Corporation, Benton Harbor, Mich.

[21] Appl. No.: 267,815

[22] Filed: Nov. 7, 1988

[51] Int. Cl.[5] ..... F25D 23/00

[52] U.S. Cl. ..... 211/153; 108/27

[58] Field of Search ..... 211/153, 134, 135; 312/137; 108/27; 52/203, 208

[56] References Cited

U.S. PATENT DOCUMENTS

| | | | |
|---|---|---|---|
| 1,805,584 | 5/1931 | Kemp | 312/137 |
| 1,878,072 | 9/1932 | Vance | 211/134 |
| 2,568,153 | 9/1951 | Hickman | 211/153 |
| 3,028,638 | 4/1962 | Goellner | 52/203 X |
| 3,220,364 | 11/1965 | Sandin | 211/153 X |
| 3,912,085 | 10/1975 | Cooke et al. | 211/153 |
| 4,242,848 | 1/1981 | Schoultz | 108/27 X |
| 4,627,201 | 12/1986 | Hamamoto et al. | 52/208 |

*Primary Examiner*—Peter A. Aschenbrenner

*Attorney, Agent, or Firm*—Mason, Kolehmainen, Rathburn & Wyss

[57] ABSTRACT

A refrigerator shelf includes a glass plate for supporting articles thereon and a plastic picture frame extending about the periphery of the plate such that the frame abuts the upper surface of the plate and projects thereabove to substantially prevent spills from running off of the shelf. The frame includes an upper frame and a lower frame which cooperate together to sandwich the periphery of the plate therebetween. A silicone seal may be further provided between the upper frame and the glass plate to positively prevent spills from seeping between the upper frame and the glass plate.

13 Claims, 2 Drawing Sheets

REFRIGERATOR SHELF AND METHOD OF MANUFACTURING

BACKGROUND OF THE INVENTION

1. Field of the Invention

The present invention relates to a refrigerator shelf and more particularly to a refrigerator having a glass plate for supporting articles thereon and a plastic picture frame having an upwardly extending flange abutting the periphery of the glass plate to prevent spills from running off of the refrigerator shelf.

2. Description of the Prior Art

A known refrigerator shelf includes a glass plate and a metal support frame having front members, rear members and side members, the side member being connected between the ends of the front and the rear members. The front end of the glass plate and the rear end thereof are respectively held between the front members and the rear members of the metal support frame with the side members of the support frame extending adjacent to the respective sides of the glass plate but spaced slightly therefrom. Because there is a slight gap between the sides of the glass plate and the side members of the metal support frame, spills on the plate may run off of the refrigerator shelf through the gap and onto other members of the refrigerator and onto the contents of the refrigerator. U.S. Pat. No. 3,912,085 shows a similar refrigerator shelf wherein the support frame further includes a flange that extends slightly inwardly from each of the side members and underneath the glass plate. Spills, however, particularly liquids, may still seep between the glass plate and the metal support frame of this refrigerator shelf.

SUMMARY OF THE INVENTION

In accordance with the present invention, the disadvantages of prior refrigerator shelves as discussed above, have been overcome. The refrigerator shelf of the present invention includes a glass plate and a plastic picture frame extending about the entire periphery of the glass plate. The picture frame abuts the upper surface of the glass plate and extends upwardly therefrom so as to substantially prevent a spill from running off of the refrigerator shelf.

More particularly, the picture frame includes an upper frame and a lower frame that cooperate to sandwich the periphery of the glass plate therebetween wherein the uppper frame includes a flange about its inner surface that abuts the upper surface of the glass plate and projects thereabove. This flange extends upwardly into a frame member that extends generally horizontally above the periphery of the glass plate with a seal disposed between the frame member and the periphery of the glass plate to prevent liquids from seeping between the glass plate and the upper frame.

The refrigerator shelf of the present invention retains spills to prevent the spills from running off of the refrigerator shelf onto other members of the refrigerator and onto the contents of the refrigerator. These and other objects, advantages and novel features of the present invention, as well as details of an illustrated embodiment thereof, will be more fully understood from the following description and the drawing.

DESCRIPTION OF THE PREFERRED EMBODIMENT

Figure 1:
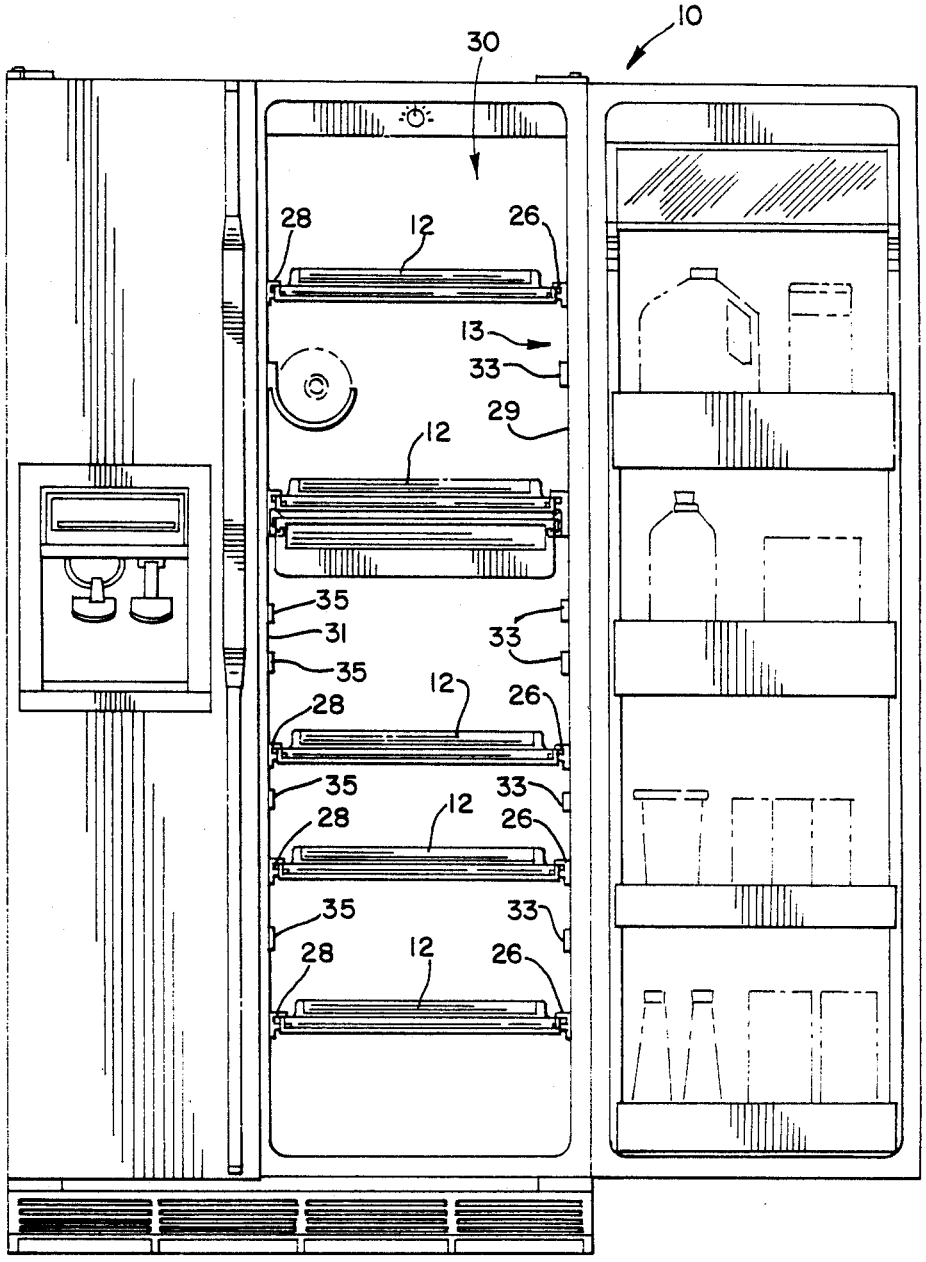
FIG. 1 is a perspective view of a refrigerator with the refrigerator shelf of the present invention mounted therein.
Figure 2:
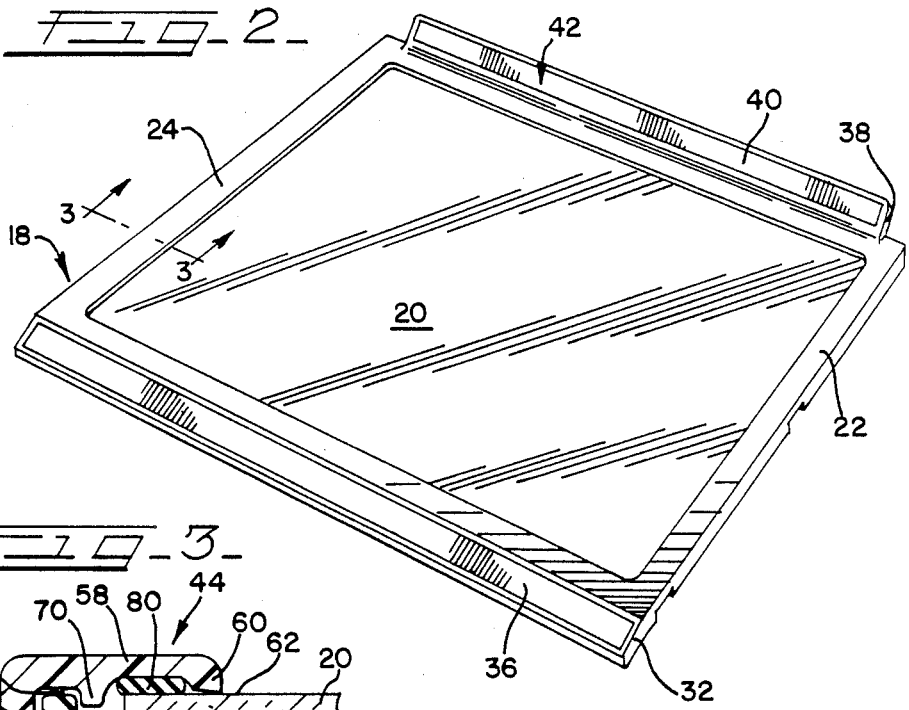
FIG. 2 is a perspective view of the refrigerator shelf of the present invention as shown in FIG. 1.

A refrigerator 10 as shown in FIG. 1 includes a number of refrigerator shelves 12, constructed in accordance with the principles of the present invention, that are mounted in a refrigerator compartment 30. Each of the refrigerator shelves 12 as shown in detail in FIGS. 2–4, includes a plate 20 of tempered glass for supporting articles thereon and a rectangular plastic picture frame 18 that extends about the entire periphery of the glass plate 20.

The sides 22 and 24 of the picture frame 18 are slidably received in respective right and left tracks 26 and 28 to mount the refrigerator shelf 12 in the refrigerator compartment 30 while enabling the shelf 12 to be pulled out therefrom. The right and left tracks 26 and 28 for mounting the refrigerator shelf 12 are removably secured to opposite sidewalls 29 and 31 of a liner 13 of the refrigerator compartment 30 so that the tracks 26 and 28 may be repositioned to allow the height of the shelves 12 to be adjusted. More particularly the track 26 is mounted on a pair of horizontally aligned studs such as a pair of studs including the stud 33 wherein the studs extend inwardly from the sidewalls 29 of the liner 13 with the stud 33 being positioned towards the front of the refrigerator compartment 30 and the other stud, not shown, being positioned towards the rear of the refrigerator compartment. Similarly, the track 28 is mounted on a pair of horizontally aligned studs such as a pair of studs including the stud 35 wherein the studs 35 extend inwardly from the liner sidewall 31 with the stud 35 being positioned towards the front of the refrigerator compartment 30 and the other stud, not shown, being positioned towards the rear of the refrigerator compartment 30. Details of the refrigerator shelf mounting system are shown in the copending U.S. patent application Ser. No. 268,296, filed concurrently herewith and incorporated herein by reference.

Figure 3:
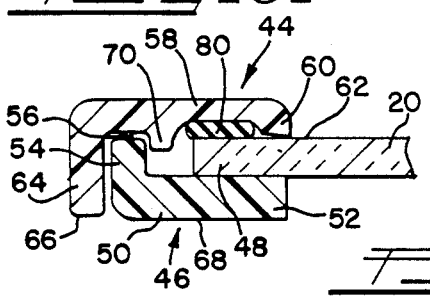
FIG. 3 is a cross-sectional view of a portion of the refrigerator she if shown in FIG. 2 taken along lines 3—3.
Figure 4:
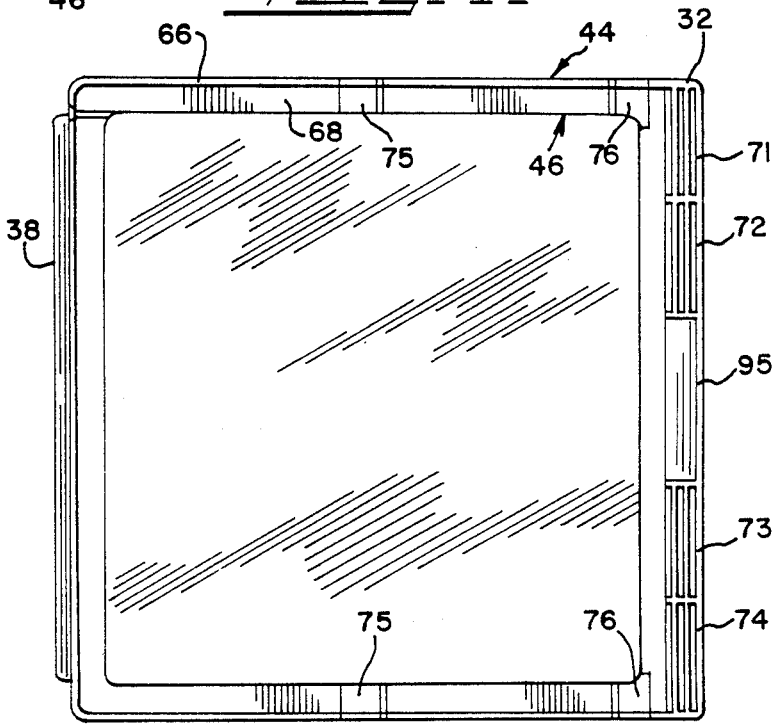
FIG. 4 is a bottom view of the refrigerator shelf shown in FIG. 2.

As shown in FIG. 3, the picture frame 18 includes an upper frame 44 and a lower frame 46 that cooperate together to sandwich a peripheral edge 48 of the glass plate 20 therebetween. The lower frame 46 includes a generally horizontally extending frame member 50 that extends beneath the periphery 48 of the glass plate and a portion of which 52, abuts the glass plate 20. A flange 54 extends upwardly from an outer surface of the frame member 50 a distance approximately equal to the thickness of the glass plate 20. A smaller flange 56 projects upwardly from the flange 54 to provide a weld bead for ultrasonically welding the upper frame 44 and the lower frame 46 together. As shown in FIG. 4, the lower frame 46 is formed with indentations 75 and 76 on the underside thereof, the indentations cooperating with a pair of stops formed on the tracks 26 and 28 so that the refrigerator shelf 12 may not be inadvertently pulled out.

The upper frame 44 of the plastic frame 18 includes a generally horizontally extending frame member 58 that extends above the periphery of the plate 20. A flange 60 extends downwardly from an inner surface of the frame member 58 so as to abut the upper surface 62 of the glass plate 20 about its entire periphery when the upper and lower frames 44 and 46 are secured together. The frame member 58 further includes a flange 64 extending downwardly from an outer surface thereof. The flange 64 extends downwardly a sufficient distance such that the bottom surface 66 thereof is slightly above the bottom surface 68 of the lower frame member 46 when the upper and lower frame members 44 and 46 are secured together so that the lower frame member 46 carries the load. A flange 70 extends downwardly from a mid-portion of the frame member 58 at a distance from the flange 64 so as to accommodate the upwardly extending flange 54 of the lower frame member 46. The flanges 64 and 70 aid in aligning the upper and lower frames 44 and 46 during the assembly of the refrigerator shelf.

The upper frame 44 further includes an integrally formed flange 32 that extends at a slight downward angle from the front 34 of the frame 18. As shown in FIG. 4, the flange 32 has four sets of ribs 71–74 with a centrally disposed gripping area 95 providing a handle pull so that the refrigerator shelf may be easily pulled out. If desired, a decorative trim such as an aluminum strip 36 may be adhesively bonded to the front face of the flange 32. An integrally formed flange 38 further extends upwardly at a slight rearward angle from the rear of the upper frame 44, the flange 38 acting as a back stop so that articles supported on the shelf 12 do not fall off the back of the shelf 12. A reflector 40 such as an aluminum strip is secured to a front face 42 of the flange 38 for a decorative effect. The reflector 40 may also reflect, towards the front of the refrigerator compartment 30, an image of the articles supported on the refrigerator shelf thereby making the article at the rear of the refrigerator compartment 30 more visible.

To positively ensure that a liquid spilled onto the glass plate 20 does not seep between the glass plate 20 and the upper frame 44, a silicone seal member 80 may be provided between the frame member 58 and the glass plate 20, abutting the flange 60. The silicone seal 80 may be in the form of a solid gasket extending about the entire periphery of the glass plate 20. Alternatively, the silicone seal may be applied between the glass plate 20 and the upper frame 44 in liquid form.

Each of the upper and lower frames 44 and 46 is molded of a plastic material. After the upper and lower frames 44 and 46 are molded, the glass plate is positioned on the lower frame 46 and the silicone seal 80 is applied to the upper frame 44 about its periphery. The upper frame 44 is positioned about the periphery of the glass plate 20 with the flange 60 abutting the upper surface 62 of the glass plate 20 and the flange 54 of the lower frame 46 extending between the flanges 64 and 70 of the upper frame. The upper and lower frames 44 and 46 are then ultrasonically welded together so as to seal the periphery 48 of the glass plate 20 between the upper and lower frames 44 and 46.

The refrigerator shelf 12 of the present invention substantially retains spills on the glass plate 20, preventing the spills from running off of the refrigerator shelf 12 and onto other members of the refrigerator 10 or the contents thereof.

What is claimed and desired to be secured by Letters patent is:

1. A refrigerator shelf comprising:

a plate having an upper surface for supporting an article thereon;

framing means for framing the entire periphery of the upper surface of said plate, said framing means abutting the upper surface of said plate and projecting thereabove to substantially prevent a spill from running off of said refrigerator shelf; and a flange extending generally upwardly from the rear of said framing means with a reflector being mounted on said flange.

2. A refrigerator shelf as recited in claim 1 including sealing means for sealing said framing means and said plate.

3. A refrigerator shelf as recited in claim 2 wherein said sealing means includes a member formed of liquid silicone.

4. A refrigerator shelf is recited in claim 2 wherein said sealing means includes a silicone gasket.

5. A refrigerator shelf as recited in claim 1 wherein said framing means is formed of molded plastic and said plate is formed of tempered glass.

6. A refrigerator shelf as recited in claim 1 wherein said framing means includes a flange extending slightly downwardly from the front of said framing means to form a grip for said refrigerator shelf.

7. A refrigerator shelf comprising:

a plate having an upper surface;

an upper frame having an upper frame member extending generally horizontally and projecting above the periphery of said plate;

a first flange extending downwardly from an inner surface of said upper frame member to abut the upper surface of said plate about the periphery of said plate;

a lower frame cooperating with said upper frame to sandwich the entire periphery of said plate between said upper and lower frames, said lower frame having a lower frame member extending generally horizontally beneath the periphery of said plate and having a flange extending upwardly from and outer surface of said lower frame member to abut an under surface of said upper frame member; and a second flange extending downwardly from an outer surface of said upper frame member such that the bottom surface of said second flange is substantially flush with the bottom surface of said lower frame member.

8. A refrigerator shelf as recited in claim 7 wherein said upper frame forms a picture frame extending about said plate.

9. A refrigerator shelf as recited in claim 7 wherein said upper frame further includes a third flange extending downwardly from said upper frame member between said first and second flanges and wherein a portion of said upwardly extending flange of said lower frame member is received between said second and third flanges of said upper frame.

10. A refrigerator shelf comprising:

a plate having an upper surface;

an upper frame;

a lower frame cooperating with said upper frame to sandwich the entire periphery of said plate between said upper and lower frames wherein said upper frame abuts the upper surface of said plate and projects thereabove; and a flange extending generally upwardly from the rear of said upper frame with a reflector being mounted on said flange.

11. A refrigerator shelf as recited in claim 10 wherein said upper frame includes a flange extending slightly downwardly from the front of said upper frame to form a grip for said refrigerator shelf.

12. A refrigerator shelf as recited in claim 10 wherein said upper and lower frames are molded of plastic.

13. A refrigerator shelf as recited in claim 10 wherein said plate is formed of tempered glass.

* * * * *